United States Patent [19]

Seal

[11] Patent Number: 4,865,110

[45] Date of Patent: Sep. 12, 1989

[54] HORIZONTAL CANTILEVERING BARRIER

[76] Inventor: Morton Seal, 5121 Muddy La., Fort Myers, Fla. 33905

[21] Appl. No.: 142,500

[22] Filed: Jan. 11, 1988

[51] Int. Cl.[4] ..... A47H 1/00

[52] U.S. Cl. ..... 160/332; 160/331; 160/125

[58] Field of Search ..... 160/331, 332, 333, 334, 160/110, 112, 125; 49/360, 324, 124

[56] References Cited

U.S. PATENT DOCUMENTS

| | | | |
|---|---|---|---|
| 1,147,944 | 7/1915 | Holdensen | 160/125 |
| 1,195,797 | 8/1916 | Enlow | 160/125 |
| 1,242,849 | 10/1917 | Parris | 160/125 X |
| 1,245,237 | 11/1917 | Johnston | 160/125 X |
| 2,886,105 | 5/1959 | Lee | 160/332 X |
| 3,502,132 | 3/1970 | Hager et al. | 160/333 X |
| 3,879,800 | 4/1975 | Adams | 160/331 X |
| 4,432,406 | 2/1984 | Belanger et al. | 160/199 |

*Primary Examiner*—Blair M. Johnson
*Attorney, Agent, or Firm*—Alfred E. Wilson

[57] ABSTRACT

As the land becomes more populated due to the land being subdivided into smaller tracts the need for barriers to indicate the boundaries of the individual property holdings increases. In many instances it is no longer necessary to provide a fence tight closure as was previously considered necessary to confine small animals such as chickens, pigs etc. As the cost of erecting and maintaining fence tight types of gates has increased during recent years many people have realized that all that is required is a barrier to indicate the extent of individual property holdings. I have devised a versitile type of barrier that can be manufactured economically, and can be maintained in service at low costs. All that is required is an elongated cylinder and piston rod combination, and an accordian type expandable barrier having one end operably connected adjacent the cylinder and the other end operably connected to the piston rod to move out to obstruct the accessway as the piston rod moves out in the cylinder and to retract and be bunched on the piston rod as the piston rod is retracted in the cylinder. I have devised a water pressure operated control for the gate. The valves controlling the flow of pressurized water to actuate the gate are controlled electrically. When no electric power is applied, the valves direct water under pressure to urge the piston rod outwardly in the cylinder to maintain the gate in the obstructing or closed position. When electric power is applied to reverse the position of the valves the piston rod moves inwardly in the cylinder whereupon the gate structure becomes nested on the piston rod. When the electric power is again shut off the water pressure moves the piston rod outwardly in the cylinder to position the barrier in the obstructing position.

4 Claims, 1 Drawing Sheet

HORIZONTAL CANTILEVERING BARRIER

BACKGROUND OF THE INVENTION

As the land is subdivided into smaller and smaller tracts the need for fence tight gates is reduced, and in order for the occupants to enjoy a degree of privacy it is generally only necessary to maintain a barrier to indicate the boundaries of the properties. As a result massive small animal tight gates are unnecessary.

FIELD OF THE INVENTION

In the development of my improved barrier it was realized that, to be successful economically, it should embody a construction that is economical to make and install and is easy to operate and to maintain, and can readily be used by all parties having need therefor, including children. A lightweight barrier is adequate since it is unnecessary to have a heavy small animal restraining device because the forces exerted thereon are not severe. It was reailized that the most successful barrier is one that is relatively lightweight, easy to operate and which can be manufactured economically and which when closed presents a sufficient apparent barrier to discourage intruders.

SUMMARY OF THE INVENTION

In the development of my improved horizontally disposed cantilevering type barrier, it is only necessary to provide a relatively long cylinder in which a somewhat longer piston rod is slidably mounted. The piston rod is slidably mounted in the cylinder and projects out of the front end of the cylinder. The piston rod has a plurality of looped vertically extending barrier structures slidably mounted on the piston rod. The inner or left hand end of the vertically extending barrier structure is secured at vertically spaced points to the post supporting the outer end of the cylinder. The outermost vertically extending barrier is secured to the outer end of the piston rod, to be carried outwardly as the piston rod is slid outwardly in the cylinder, and the vertically extending barrier structure is moved outwardly as the piston rod moves in the cylinder. When the piston rod is projected outwardly to its full extent the vertically extending barrier structure is spaced across the accessway to indicate that the accessway is closed. When the piston rod approaches the end of its travel the sharpened end projects into the aperture to stabilize the unit.

The barrier structure is illustrated as being operated by water pressure exerted between the cylinder and the piston to maintain the piston rod in the fully extended position to close the accessway when the water pressure is operable to project the piston rod outwardly in the cylinder. To open the barrier the cylinder is vented, and water pressure is exerted between the right hand end of the cylinder and the piston rod to retract the piston rod in the cylinder. The vertically extending members of the barrier then slide on the piston rod as the accessway is opened.

DESCRIPTION OF THE PREFERRED EMBODIMENT

Figure 1:
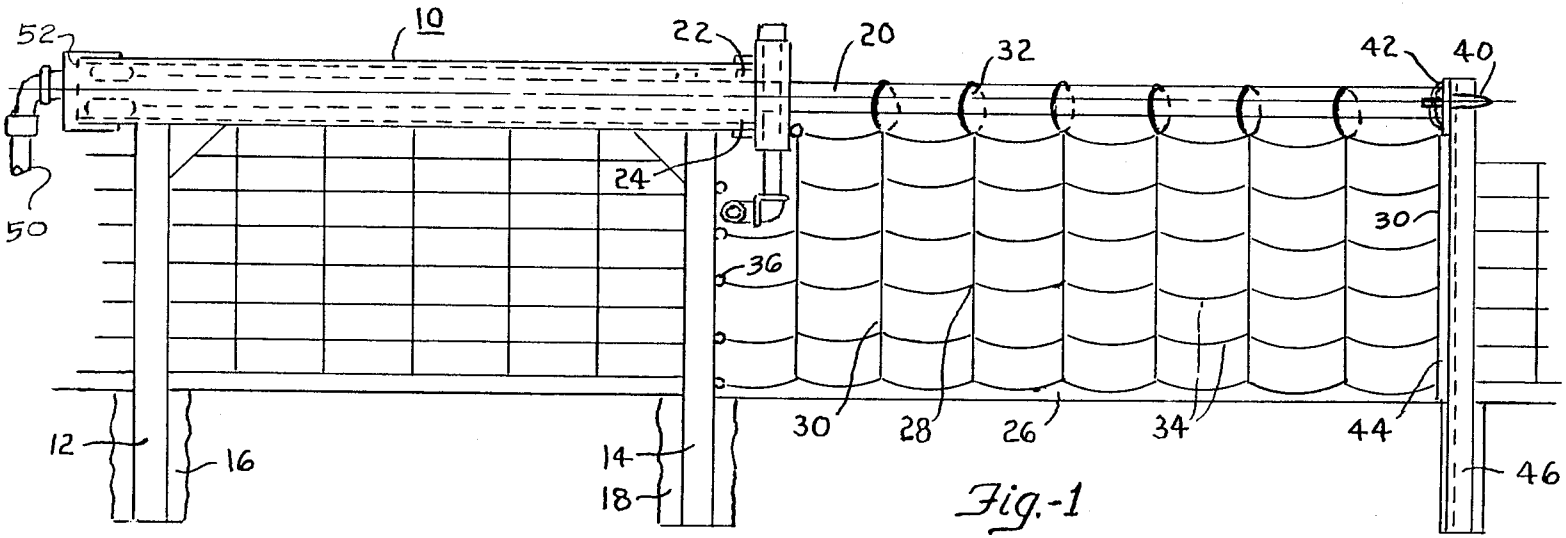
FIG. 1 is a side elevational view of the barrier structure adapted to project the piston rod outwardly in the cylinder to close the accessway, and being illustrated in the gate closed position.
Figure 3:
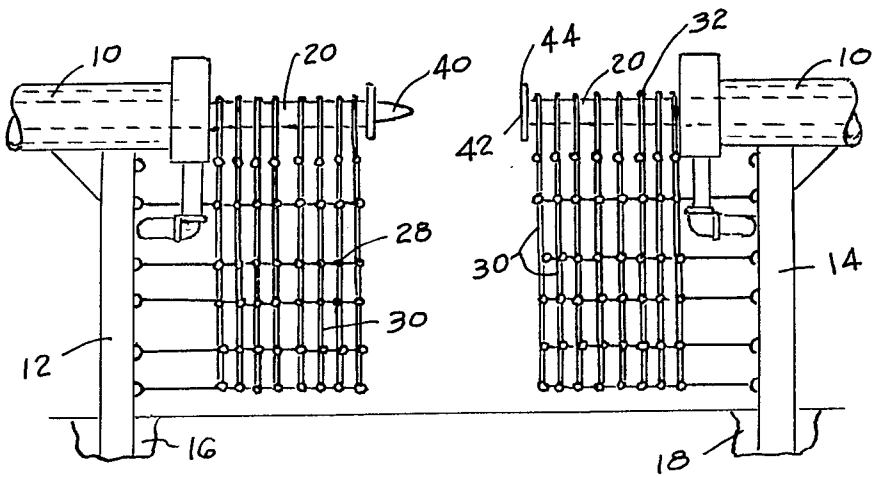
FIG. 3 is a side elevational view of a double acting barrier structure wherein barrier structures operate in opposite directions to close a wider accessway.
Figure 2:
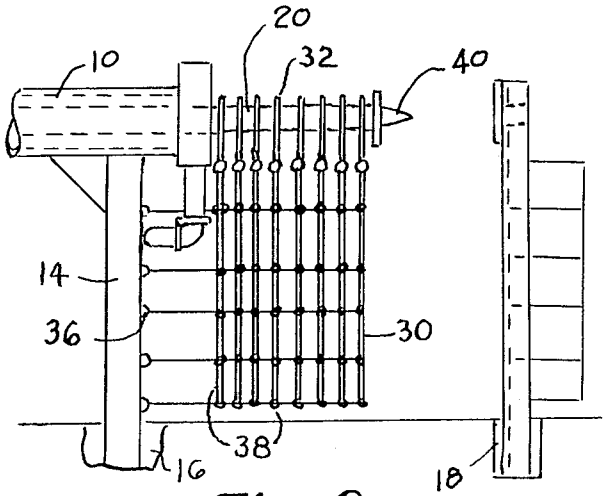
FIG. 2 is a view similar to FIG. 1, but showing the gate construction in the gate open position wherein the vertical barrier members are nested so as to be cluttered at the end of the piston rod, at which time the piston is in the fully retracted position in the cylinder.

Referring now to FIGS. 1 and 2, a cylinder 10 is mounted on suitable supports or posts 12 and 14 secured in the ground on suitable footers 16 and 18 to insure a solid support for the cylinder 10.

The elongated piston rod 20 is slidably mounted in the cylinder 10 and is guided therein by a ferrole 24 at the outer or right hand end of the cylinder 10.

The piston rod 20 is of sufficient length to extend completely across the accessway 26 to be controlled by the barrier 28. The barrier 28 is of the accordian type having vertically extending wire or rod members 30 having looped portions 32 loosely surrounding the piston rod 20. The vertically extending wire members 30 are connected by horizontal connectors 34 having their inner ends connected to the support or post 14 as illustrated at 36, and having tied connectors with the vertically extending wire members 30 to position the vertically extending members in substantially equal spacings as illustrated in FIG. 1.

Thus when the barrier 28 is in the fully extended position as illustrated in FIG. 1, the vertically extending wires 30 are substantially equally spaced as illustrated, and the outer end of the piston rod 20 is provided with a sharpened point 40 to project into an aperture 42 in a plate 44 carried by a post or support 46.

This type of barrier has been loosely referred to as a ladder type, the outer end of which travels with the piston rod 20 so as to indicate that the accessway 26 to the entrance is closed when the barrier 28 is in the closed position by the movement of the piston rod 20 to the fully extended position as shown in FIG. 1.

In the event that a barrier or gate structure is wider than can conveniently be accomodated by a single piston rod 20, it is possible to have gate or barrier structures operating from opposite sides of the accessway 26. In this construction one of the barrier piston rods 20 is provided with the sharpened point 40 to project into the aperture 42 in the plate 44 carried by the other movable barrier structure so that when both of the barrier members are moved towards each other the upper edge of the barrier will be stabilized and maintained in the closed position.

This type of gate structure is very economical to construct, and it is very good from a maintenance point of view because there is very little that can go wrong with it, and it can be readily patched in the event that tears or breaks occur in the vertically extending members 30 or the transversely extending members 34 which provide the collapsable closure to indicate that the accessway 26 is closed when the piston rods 20 are extended to the full outward position.

When the piston rods 20 are retracted in the cylinders 10 the gate structure moves to the collapsed or contracted position illustrated in FIG. 2 wherein the vertical members or wires 30 looped over the piston rods 20 and held thereon by the loops 32 are slidably mounted on the piston rod 20 to the contracted or open position of the barrier 28.

While many types of gate actuators are available and are operable to actuate the laterally movable piston rods 20 of the barrier 28 I have devised a water pressure and electrically controlled gate actuator. When water is under sufficient pressure, considering the diameters of the cylinder 10 and the piston 22 to exert a force sufficient to move the piston rods 20 outwardly in the cylinders 10 the barriers 28 will be moved to the obstructing position. The water inlet pipe 50 directs pressurized water to the left hand end of the cylinder 10. To move the barrier 28 to the nonobstructing position, pressurized water is directed by a pipe to the right hand end of the cylinder 10 and is exerted in the chamber between the cylinder 10 and the piston 22.

In my copending application Ser. No. 142499, filed concurrently herewith, I have illustrated and described a barrier actuator that is operated by water pressure, and is controlled electrically. I selected this type of actuator because pressurized water is available to water lawns and to irrigate growing plants. As a result it is generally true that pressurized water can be available merely by extending a water hose to the gate area.

In both constructions the gate or barrier can be moved in opposite directions to open or close a gate or barrier structure by merely reversing the flow of pressurized water at opposite ends of a cylinder having a piston rod slidably mounted therein and actuated water under pressure.

When the device is at rest and no electric current is supplied to the control valves, pressurized water is transmitted by the pipe 50 to the left hand end of the cylinder 10 and the barrier 28 is moved outwardly to the obstructing position.

When it is desired to move the barrier 28 to the open position the electrically actuated control valves are shifted to close the chamber between the left end of the cylinder 10 and the piston 22 and to open the chamber between the right hand end of the cylinder 10 and the piston rod 20 to withdraw the piston rod 20 into the cylinder 10 thereby removing the barrier 28 from the accessway 26.

I claim:

1. A closure barrier comprising an elongated cylinder, stationary spaced apart cylinder supports, a piston rod having a free end and being slidably mounted in the cylinder and extendable from an outer end thereof, an accordian type expandable barrier having one end which is secured adjacent the outer end of the cylinder and another end secured to the free end of the piston rod and being so constructed and arranged that in the barrier open position the expandable barrier is bunched at the free end of the piston rod and in the barrier closed position the expandable barrier is laterally spaced along the length of the piston rod.

2. A closure barrier comprising two laterally spaced elongated cylinders each having stationary spaced supports, piston rods slidably mounted in the cylinders and each having a free end which extends from an outer end of a respective cylinder, an accordian type expandable barrier having one end which is secured adjacent the outer end of each of the cylinders and another end of each barrier secured to the free end of its associated piston rod and being so constructed and arranged that in the barrier open position the expandable barriers are bunched at the free ends of the piston rods and in the barrier closed position the expandable barriers are laterally spaced along the length of their associated piston rod.

3. A closure barrier comprising two fixed elongated horizontally disposed cylinders, a piston rod slidably mounted in each cylinder and movable between a retracted position in the cylinder and an extended position, a collapsible ladder type barrier structure, a portion of which being mounted on each of said piston rods and being movable between a barrier closed position when the piston rods are in an extended position relative to the cylinder,. and a barrier open position when the piston rods are in a retracted position relative to their cylinders.

4. The invention defined in claim 3 wherein the piston rods are moved from a retracted position in their cylinders by fluid pressure exerted between the cylinders and the piston rods at the ends of the cylinders at which the piston rods are in the retracted position relative to the cylinders to position the barrier in an obstructing position.

* * * * *